US007438403B2

(12) United States Patent
Takahashi

(10) Patent No.: US 7,438,403 B2
(45) Date of Patent: Oct. 21, 2008

(54) INKJET PRINTHEAD WITH COMPENSATING MEMBER

(75) Inventor: Yoshikazu Takahashi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 373 days.

(21) Appl. No.: 11/185,277

(22) Filed: Jul. 19, 2005

(65) Prior Publication Data

US 2006/0017786 A1 Jan. 26, 2006

(30) Foreign Application Priority Data

Jul. 20, 2004 (JP) ..... 2004-211841

(51) Int. Cl.
*B41J 2/17* (2006.01)
*B41J 2/45* (2006.01)
*B41J 2/175* (2006.01)

(52) U.S. Cl. ..... 347/94; 347/71; 347/93

(58) Field of Classification Search ..... 347/94
See application file for complete search history.

(56) References Cited

U.S. PATENT DOCUMENTS

| | | | | |
|---|---|---|---|---|
| 4,167,742 | A * | 9/1979 | Head et al. | 347/94 |
| 5,402,159 | A | 3/1995 | Takashashi et al. | |
| 5,682,190 | A * | 10/1997 | Hirosawa et al. | 347/94 |
| 5,943,079 | A * | 8/1999 | Yoshida | 347/94 |
| 6,250,753 | B1 * | 6/2001 | Nishiwaki et al. | 347/94 |
| 6,648,452 | B2 | 11/2003 | Ito | |
| 6,685,299 | B2 * | 2/2004 | Hirota | 347/70 |
| 6,752,489 | B2 * | 6/2004 | Ohashi et al. | 347/65 |
| 7,264,338 | B2 * | 9/2007 | Ogata et al. | 347/70 |

FOREIGN PATENT DOCUMENTS

| | | | |
|---|---|---|---|
| JP | 55071569 | A * | 5/1980 |
| JP | 59098860 | A * | 6/1984 |
| JP | 01308643 | A * | 12/1989 |
| JP | 01308644 | A * | 12/1989 |
| JP | 02111550 | A * | 4/1990 |
| JP | 03234631 | A * | 10/1991 |
| JP | 03284949 | A * | 12/1991 |
| JP | A-4-341853 | | 11/1992 |
| JP | A-7-171969 | | 7/1995 |
| JP | A-2000-43253 | | 2/2000 |
| JP | A-2002-137386 | | 5/2002 |

* cited by examiner

*Primary Examiner*—Matthew Luu
*Assistant Examiner*—Shelby Fidler
(74) *Attorney, Agent, or Firm*—Reed Smith LLP

(57) ABSTRACT

An inkjet printhead includes: a cavity unit having aligned nozzles, pressure chambers correspondingly aligned, and a common-chamber member having a common chamber connected, at an introduction place, to an ink source to receive and distribute ink to the pressure chambers, and extending along the pressure chambers row to overlap each pressure chamber when seen in the superposition direction, and a cross-sectional area of the common chamber perpendicular to its longitudinal direction gradually decreases in a direction away from the introduction place, at a portion remote from the introduction place; an actuator on the cavity unit to pressurize the distributed ink to eject ink droplets from the nozzles; and a compensating member having a rigidity lower than that of the common-chamber member, and being disposed in contact with the ink, at the remote portion so that a supporting rigidity of the common-chamber member is substantially uniform along the pressure chambers row.

19 Claims, 9 Drawing Sheets

INKJET PRINTHEAD WITH COMPENSATING MEMBER

INCORPORATION BY REFERENCE

The present application is based on Japanese Patent Application No. 2004-211841, filed on Jul. 20, 2004, the content of which is incorporated herein by reference.

BACKGROUND OF THE INVENTION

1. Field of the Invention

The invention relates to an inkjet printhead, and particularly to an inkjet printhead having a plurality of pressure chambers, and a common ink chamber from which ink is distributed to the pressure chambers.

2. Description of the Related Art

As disclosed in JP-A-2000-43253 (especially FIG. 1) for instance, there is known an inkjet printhead comprising a cavity unit which is a laminate of a plurality of plates, and a piezoelectric actuator unit superposed on the cavity unit. The plates constituting the cavity unit include a nozzle plate through which a plurality of nozzles are formed in a row, a cavity plate through which a plurality of through-holes constituting a plurality of pressure chambers are formed in a row to positionally correspond to the row of the nozzles, and a manifold plate through which a through-hole constituting a common ink chamber is formed to store ink supplied from an ink supply source and to distribute the ink to the pressure chambers. The piezoelectric actuator unit is disposed on the cavity unit so as to selectively pressurize the ink in the pressure chambers, to eject droplets of the ink from the nozzles as desired. The common ink chamber is formed through the manifold plate to be elongate in the direction of the alignment of the pressure chambers such that the common ink chamber overlaps a part of each pressure chamber in plan view, that is, when seen in the direction of the superposition of the cavity and actuator units. The ink is introduced into the common ink chamber at an ink introduction place located at a first one of two opposite longitudinal ends of the common ink chamber, and flows toward a second or the other longitudinal end, as the ink is distributed to the pressure chambers sequentially.

In such a printhead, when the width of the common ink chamber is constant throughout the entire length thereof, there is a high possibility of failure in ejection of ink droplets, that is, ink droplets may not be properly ejected as intended, or may be completely failed to be ejected. This is because that as the ink introduced at the ink introduction place flows in the common ink chamber toward the second longitudinal end far from the ink introduction place, the ink flow decelerates, and stagnation of the ink flow tends to occur at the second longitudinal end, causing accumulation or stay of air bubbles there which leads to the failure in ejection of ink droplets.

In order to prevent the stagnation of the ink and solve the problem with the accumulation of air bubbles, the above-mentioned publication discloses to narrow the common ink chamber at the second longitudinal end so as to gradually reduce the cross-sectional area of the common ink chamber perpendicular to the longitudinal direction of the common ink chamber.

Meanwhile, all the pressure chambers have a same length. Thus, in the manifold plate, the ratio of an open area (corresponding to the through-hole of the common ink chamber) to a non-open area (corresponding to the material or substance forming the manifold plate and present around the common ink chamber) at a place corresponding to each of the pressure chambers varies among the pressure chambers. In other words, the ratio of the open area to the non-open area varies along the longitudinal direction of the common ink chamber This produces a variation in the rigidity of a member or members surrounding the pressure chambers aligned along the longitudinal direction of the common ink chamber. Hence, the characteristic period of propagation of a pressure wave in the ink through an ink channel which is partially constituted by each pressure chamber varies among the pressure chambers. That is, the characteristic period of pressure wave propagation is a period of time taken for a pressure wave generated in the ink in a pressure chamber when the piezoelectric actuator unit is driven, to propagate to and back from the nozzle, or to propagate both ways with respect to the longitudinal direction of the pressure chamber. The characteristic period is a function of the length of the pressure chamber, the sound speed in the ink, and the rigidity of the member(s) surrounding the pressure chamber or the characteristic period. Since an ink droplet is ejected through a nozzle based on the pressure wave, or by superposing the next pressure wave on a pressure wave, the two pressure chambers at the opposite ends of the row of the pressure chambers and located over the opposite ends of the common ink chamber exhibit a difference in their ink ejection characteristics, such as the speed of the ejected ink droplet and the stability in the ink ejection, for a same drive signal.

In view of this problem, the present applicant has proposed, in JP-A-2002-137386 (especially FIG. 9), to compensate for the variation in a supporting rigidity of the manifold plate with respect to the pressure chambers, along the longitudinal direction of the common ink chamber, by forming an empty chamber at the side of the narrowed portion of the common ink chamber such that the sum of the cross-sectional area of the common ink chamber and that of the empty chamber as taken in the direction perpendicular to the longitudinal direction of the common ink chamber is substantially identical at every position in the longitudinal direction. Thus, it is designed to uniform the supporting rigidity of the manifold plate with respect to the pressure chambers across a region corresponding to the row of the pressure chambers.

With such an empty chamber, this conventional technique succeeds in substantially reducing the variation in the rigidity along the direction of the row of the pressure chambers. However, the empty chamber and the common ink chamber in which air and the ink are accommodated, respectively, are provided by through-holes formed through the manifold plate which is of metal, with the metal material of the manifold plate present between the empty chamber and the common ink chamber. Thus, the common ink chamber is surrounded, along the entire circumference thereof inclusive of its narrowed portion, by the highly rigid metal material, resulting in a difference in the speed of the one-way propagation of pressure in the ink, between the pressure chamber corresponding to the narrowed portion under influence of the presence of the metal material between the empty chamber and common ink chamber, and the pressure chamber corresponding to the other portion free from such influence. Thus, this technique fails to eliminate the variation in the ink ejection characteristics completely, and a further improvement has been desired in this regard.

SUMMARY OF THE INVENTION

Te present invention has been developed in view of the above-described situations, and an object of the invention is, thereof, to provide an inkjet printhead capable of preventing the accumulation or stay of the air bubbles in the common ink chamber while achieving the uniformity in the rigidity of the material defining the common ink chamber in a region across which the pressure chambers are aligned, in order to uniform the ink ejection characteristics.

To attain the object, the invention provides an inkjet printhead including:

a cavity unit having:

a plurality of nozzles which are open in a surface of the cavity unit and arranged in a row;

a plurality of pressure chambers formed in a row in the cavity unit to positionally correspond to the nozzles; and a common-chamber member in which a common ink chamber is formed, the common ink chamber being connected, at at least one ink introduction place, to an ink supply source storing ink so as to receive the ink therefrom and distribute the ink to the pressure chambers;

an actuator unit superposed on the cavity unit to selectively pressurize the ink in each of the pressure chambers to eject a droplet of the ink from the nozzle corresponding to the pressure chamber;

the common ink chamber extending along the row of the pressure chambers so as to overlap at least a part of each pressure chamber when seen in a direction of superposition of the cavity unit and the actuator unit; and a compensating member having a rigidity lower than that of the common-chamber member, and disposed in the common ink chamber and in contact with the ink, at at least a remote portion far from the at least one ink introduction place, so that a cross-sectional area of the common ink chamber perpendicular to the longitudinal direction thereof gradually decreases at least at the remote portion in a direction away from each of the at least one ink introduction place, and a supporting rigidity of the common-chamber member with respect to the pressure chambers is substantially uniform across a region corresponding to the row of the pressure chambers, along the direction of the row of the pressure chambers.

According to this arrangement, since the cross-sectional area of the common ink chamber perpendicular to the longitudinal direction of the common ink chamber gradually decreases in a direction away from the ink introduction place, at the remote portion far from the ink introduction place, the ink flow in the common ink chamber does not stagnate at the remote portion far from the ink introduction place, thereby preventing deterioration in the ink ejection characteristics due to accumulation or stay of air bubbles which would be otherwise caused by stagnation of the ink flow.

At at least the remote portion where the cross-sectional area decreases, there is disposed, in contact with the ink, the compensating member having a rigidity lower than that of the common-chamber member, in which the common ink chamber is formed. The provision of the compensating member prevents increase in the supporting rigidity of the common-chamber member with respect to the pressure chambers at an area around the remote portion compared with the other area. Hence, the rigidity of a member or members surrounding and defining the pressure chambers in the cavity unit is made substantially uniform in terms of reception of pressure or force from the pressure chambers, among all the pressure chambers in the same row. Accordingly, the ink ejection characteristics is made uniform among all the pressure chambers in the row, thereby improving the print quality.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described presently preferred embodiments of the invention, by referring to the accompanying drawings.

Figure 1:
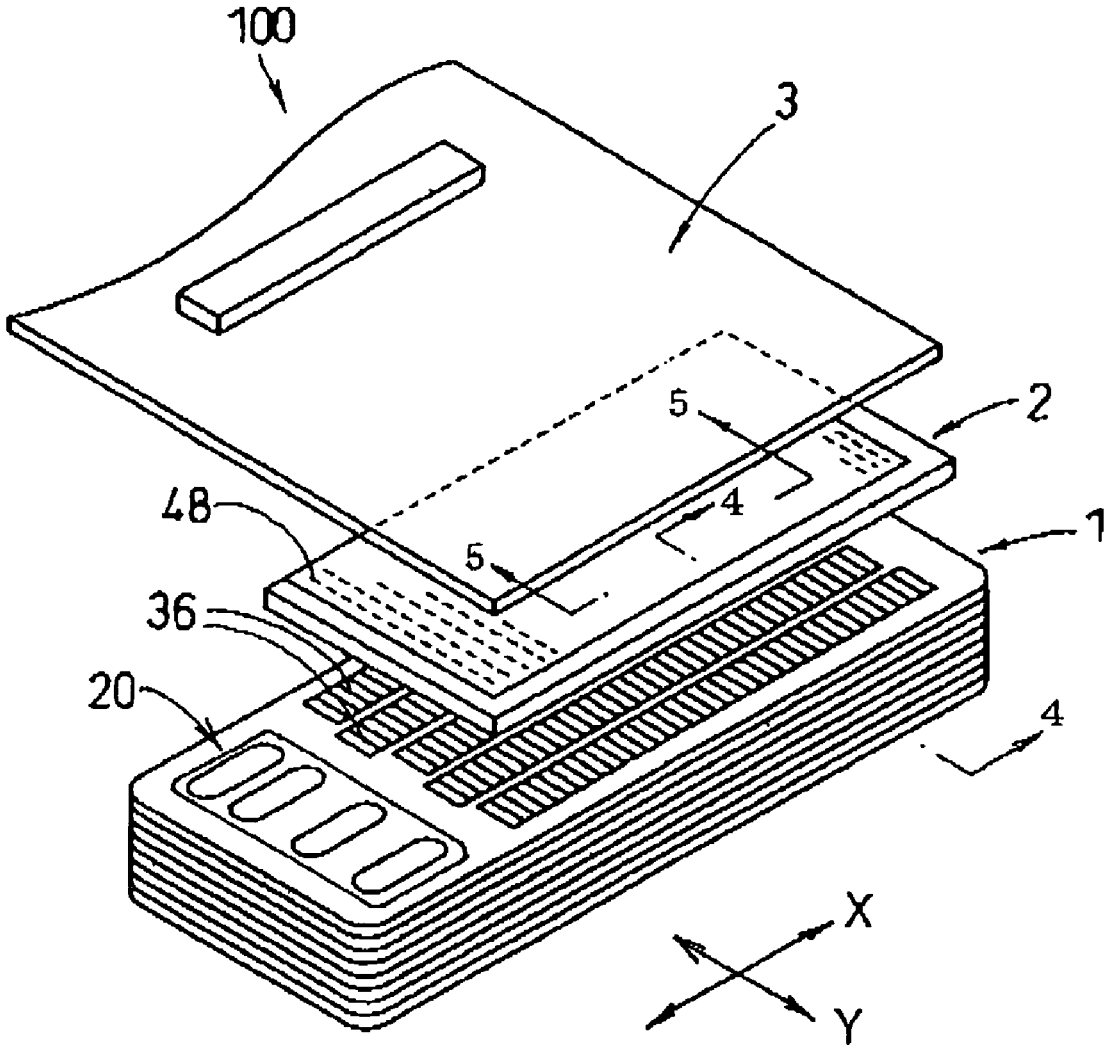
FIG. 1 is a perspective view of an inkjet printhead according to a first embodiment of the invention.

There will be described an inkjet printhead according to a first embodiment of the invention, referring to FIGS. 1-7. In FIG. 1, reference numeral 100 denotes an inkjet printhead of piezoelectric type, which is formed by attaching a planar piezoelectric actuator unit 2 to a cavity unit 1 comprising a plurality of metal plates. A flexible flat cable 3 is superposed on and attached to an upper surface of the planar piezoelectric actuator unit 2 so as to connect the printhead 100 with an external device. A large number of nozzles 4 are arranged in an undersurface of the cavity unit 1 to eject droplets of ink downward therethrough.

Figure 2:
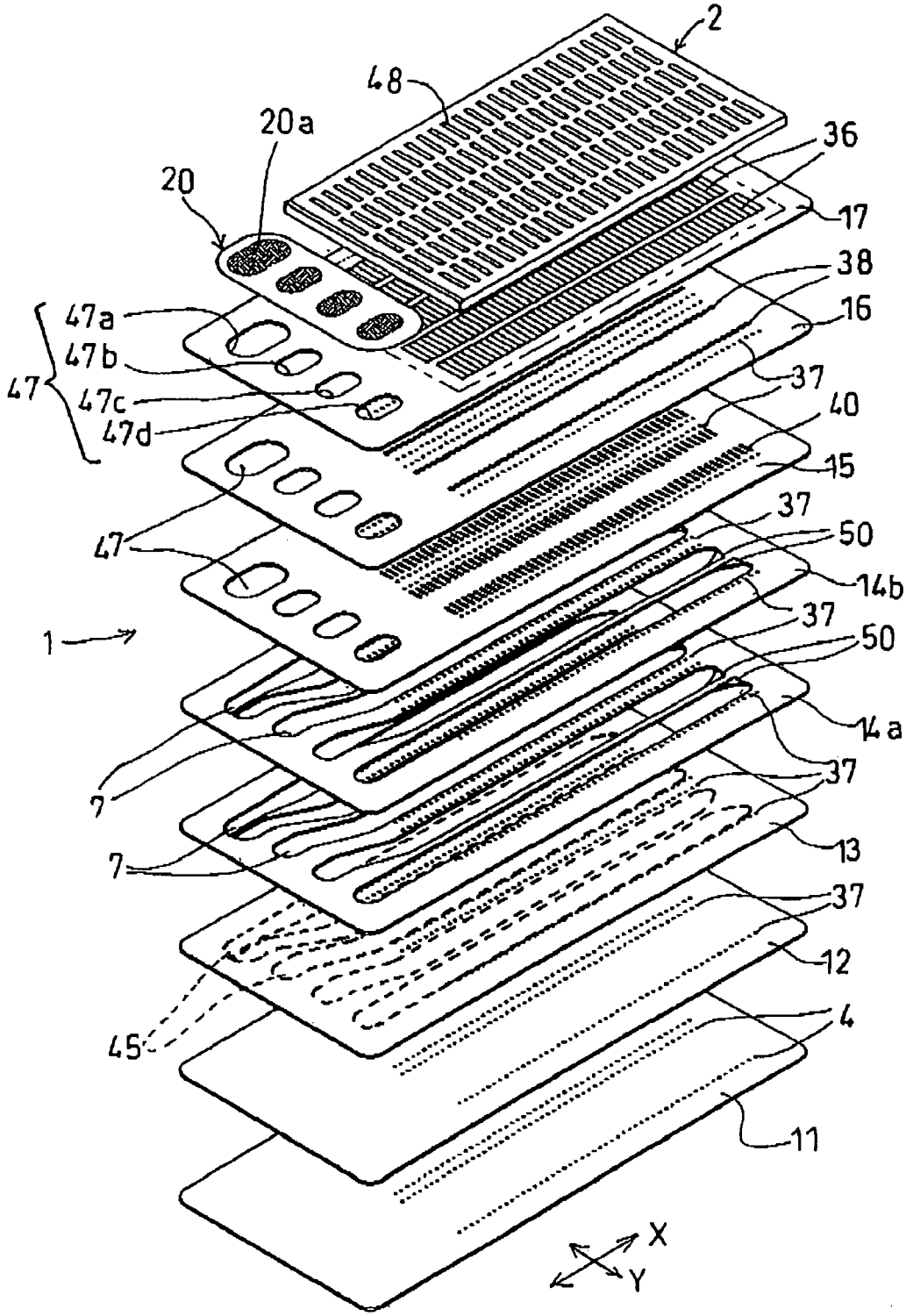
FIG. 2 is an exploded perspective view showing the printhead in enlargement.

As shown in FIG. 2, the cavity unit 1 comprises a laminate of thin plates nine in total, namely, a nozzle plate 11, a spacer plate 12, a damper plate 13, two manifold plates 14*a*, 14*b*, a supply plate 15, a base plate 16, and a cavity plate 17, which are superposed on and bonded to one another with an adhesive.

Each of the plates 11-17 has a thickness of about 50 to 150 μm. The nozzle plate 11 is made of a synthetic resin such as polyimide, and the other plates 12-17 are formed of a steel plate of 42% nickel alloy. The nozzles 4 for ejecting ink droplets are formed at very small intervals through the nozzle plate 11. The diameter of the nozzles is very small and about 25 μm, The nozzles 4 are arranged in five rows each along a longitudinal direction of the nozzle plate 11, and in a staggered fashion. The longitudinal direction of the nozzle plate 11 may be referred to as an X-axis direction.

Figure 3:
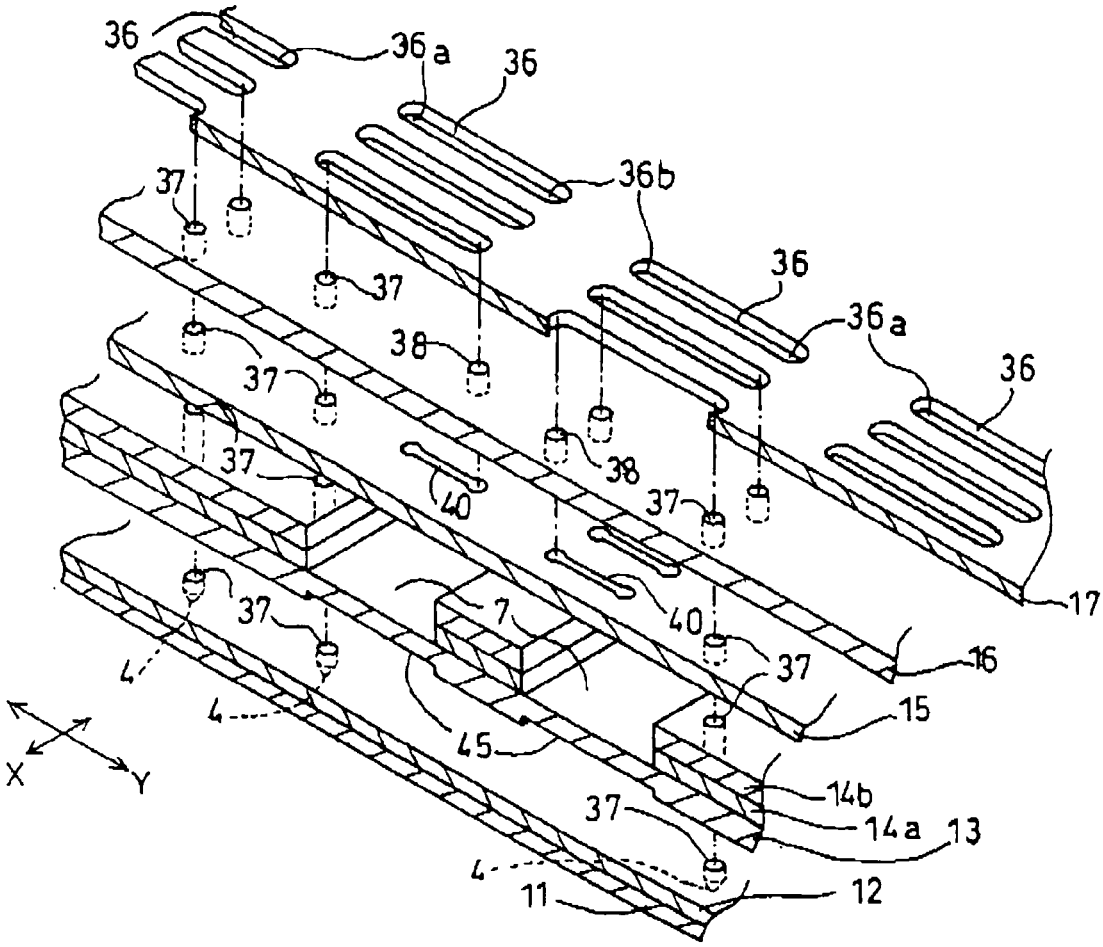
FIG. 3 is an exploded perspective view showing a cavity unit of the printhead in enlargement.

As shown in FIG. 3, a plurality of pressure chambers 36 are formed through the cavity plate 17 in five rows each along the longitudinal direction of the cavity plate 17 or the X-axis direction, and in a staggered fashion. The pressure chambers 36 are elongate in plan view, and their longitudinal direction is parallel to a direction of shorter sides of the cavity plate 17, which may be referred to as a Y-axis direction. One 36*a* of opposite longitudinal ends of each pressure chamber 36 is in communication with one of the nozzles 4, and the other longitudinal end 36*b* is in communication with one of a plurality of common ink chambers 7, as will be described later.

More specifically, the end 36*a* of the pressure chamber 36 is communicated with the nozzle 4 formed through the nozzle plate 11, via communication holes 37 of small diameter formed in a staggered fashion similar to the pressure chambers 36 through each of the plates 12-16, namely, the base plate 16, the supply plate 15, the two manifold plates 14*a*, 14*b*, the damper plate 13, and the spacer plate 12.

Through the base plate 16 immediately under the cavity plate 17 are formed a plurality of through-holes 38 respectively connected to the ends 36*b* of the pressure chambers 36.

Through the supply plate 15 immediately under the base plate 16 are formed a plurality of connecting passages 40 for supplying ink in the common ink chamber 7 (described later) to the connected pressure chambers 36. Each connecting passage 40 has an inlet for introducing the ink from the common ink chamber 7, an outlet open toward the pressure chamber 36, more specifically, open to the through-hole 38, and an orifice part connecting the inlet and the outlet and having a smaller cross-sectional area than that of the inlet and outlet so as to provide the highest resistance in the connecting passage 40 to the flow of the ink from the common ink chamber 7 toward the pressure chambers.

Figure 4:
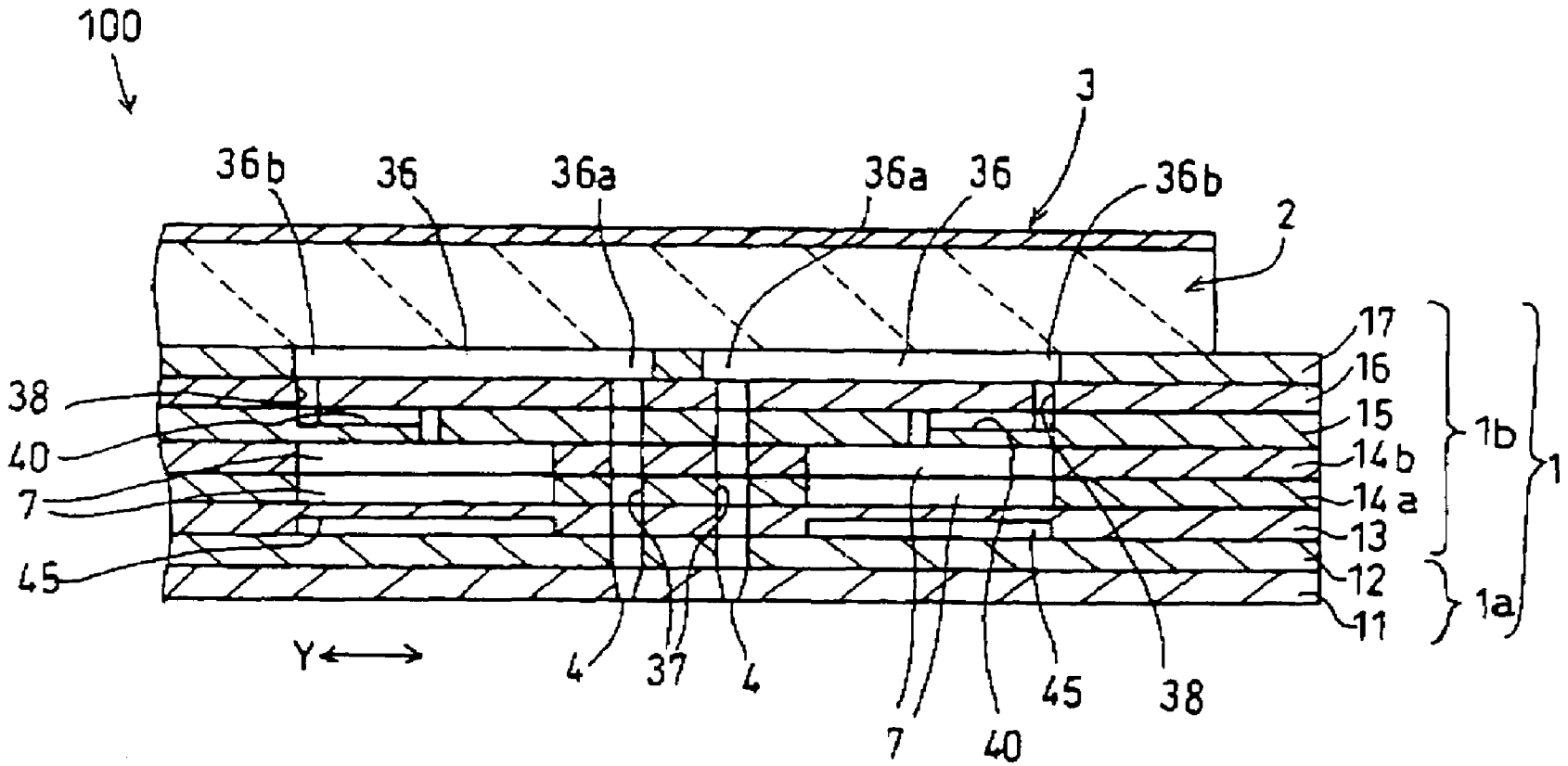
FIG. 4 is a cross-sectional view as taken along line 4-4 in FIG. 1.
Figure 5:
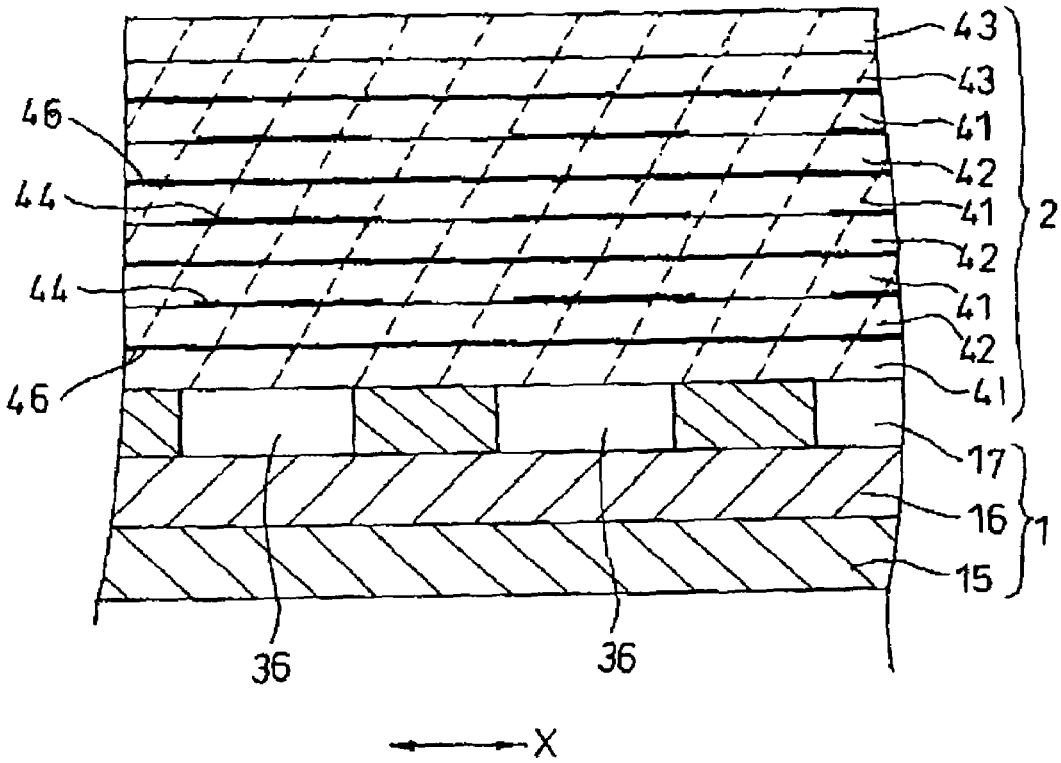
FIG. 5 is a cross-sectional view as taken along line 5-5 in FIG. 1.

Through the two manifold plates 14*a*, 14*b* are formed five common ink chambers 7 each elongate in the longitudinal direction of the manifold plates 14*a*, 14*b* or the X-axis direction, which is parallel to each row of the nozzles. That is, as shown in FIGS. 2 and 4, the two manifold plates 14*a*, 14*b* are stacked and the upper side of the manifold plates 14*b* is covered by the supply plate 15 while the lower side of the manifold plate 14*a* is covered by the damper plate 13, so that five closed manifold chambers or common ink chambers 7 are formed. When seen in the direction of the stacking of the plates of the cavity unit, each common ink chamber 7 extends along the direction of each row of the pressure chambers 36 (i.e., along the direction of each row of the nozzles 4, and the X-axis direction) to overlap a part of each of the pressure chambers 36 of a positionally corresponding row.

A first one of two opposite longitudinal ends of each common ink chamber 7 is in communication with an ink supply port 47 connected to an ink supply source, so that the ink is introduced into the common ink chamber 7 from this first longitudinal end. The common ink chamber 7 is configured such that at least at its second longitudinal end opposite to the first longitudinal end from which the ink is introduced, the cross-sectional area of the common ink chamber 7 perpendicular to the longitudinal direction of the common ink chamber 7 gradually decreases from the side of the ink supply port 47 toward the second longitudinal end. In the present embodiment as a specific example of such an arrangement, the width of the common ink chamber 7 perpendicular to the longitudinal direction of the common ink chamber is gradually reduced, so as to decrease the cross-sectional area as described above. Hereinafter, the portion of the common ink chamber 7 where the cross-sectional area decreases in the above-mentioned way will be referred to as "the narrowed portion".

The arrangement of this embodiment where the cross-sectional area of the common ink chamber is decreased by reducing the width of the common ink chamber is advantageous in that the cross-sectional area can be changed without varying the depth of the common ink chamber, which is determined by the thickness of the manifold plates 14*a*, 14*b* constituting a common-chamber member, and thus the manufacturing of the cavity unit is facilitated.

In order to virtually uniform the rigidity of the material or members defining the common ink chambers 7, in a region across which the pressure chambers 36 are arranged, or, in the direction of each row of the pressure chambers 36, a compensating member having a rigidity smaller than that of the material or members defining the common ink chambers 7 is disposed in the narrowed portion in each common ink chamber 7 such that the compensating member is in contact with the ink in the common ink chamber 7.

In the present embodiment the common ink chambers 7 are formed through the manifold plates 14*a*, 14*b* which are made of metal as mentioned above, and the compensating member is constituted by an elastic material 50 having a rigidity smaller than that of the manifold plates 14*a*, 14*b*. The elastic material 50 fills a portion of each common ink chamber 7 at the second longitudinal end. A silicone rubber exhibiting an excellent ink resistance is suitably employed as the elastic material 50.

Since the common ink chambers 7 are formed in the manifold plates 14*a*, 14*b* made of a metal as a common-chamber member, while a compensating member disposed to reduce the cross-sectional area of the common ink chamber is constituted by an elastic material 50 (i.e., a silicone rubber) having an extremely low rigidity compared with the metal, it can be virtually considered, in terms of the rigidity, such that the diminution for decreasing the cross-sectional area is not provided in the common ink chamber, or the common ink chamber is constant in width throughout its entire length.

The silicone rubber is excellent in ink resistance, and thus contact of the compensating member formed of silicone rubber with the ink does not cause any inconvenience.

There will be described in detail how the common ink chambers 7 are formed. Initially, there are prepared five precursory through-holes (which are to be the common ink chambers 7) in each of the manifold plates 14*a*, 14*b*. Each through-hole has a constant width W throughout its entire length, except at the longitudinal end to be connected to the ink supply port 47. A portion A of each common ink chamber 7 at the second longitudinal end is filled with the elastic material 50, along one of the longer sides of the common ink chamber 7, so that there is provided a narrowed portion with a curved surface. In the other portion B except the portion connected to the ink supply port 47, the width of the common ink chamber 7 is not decreased but is constant at W.

This process of forming the common ink chambers 7, according to which there are first formed the precursory through-holes having a constant width throughout their entire length, namely, from the first longitudinal end to be connected to the ink supply source (or the ink supply port) to the second longitudinal end remote from or opposite to the first longitudinal end, and then the second longitudinal ends are filled with the elastic material 50 with a lower rigidity, is advantageous in that the rigidity of the manifold plates 14*a*, 14*b*, which is relatively high, is made uniform along each row of the pressure chambers.

On a lower surface of the damper plate 13 immediately under the manifold plate 14*a*, there are formed five elongate recesses to constitute five damper chambers 45 positionally corresponding to but isolated from the common ink chambers 7, as shown in FIGS. 3 and 4. The position and shape of each damper chamber 45 correspond to those of the common ink chamber 7 located above the damper chamber 45, namely, the position and shape of the ink as accommodated in the common ink chamber 7 above the damper chamber 45. Since the damper plate 13 is formed of a metal material capable of elastic deformation as needed, a thin ceiling part over the damper chamber 45 can freely vibrate or displace toward both of the common ink chamber 7 and the damper chamber 45. When an ink droplet is to be ejected from a nozzle, the ink in the corresponding pressure chamber 36 is pressurized, and this pressure change propagates to the common ink chamber 7. This propagated pressure change is absorbed or damped by the vibration or elastic deformation of the ceiling part of the damper plate 13. That is, a damping effect is provided by the ceiling part. There can be thus prevented a crosstalk that the pressure change caused in a pressure chamber 36 is undesirably propagated to another pressure chamber 36.

As shown in FIG. 2, at one of two opposite longitudinal ends of each of the cavity plate 17, base plate 16, and supply plate 16, there are formed four through-holes so that four ink supply ports 47 are formed when these plates 15-17 are positioned relatively to each other and stacked. The ink from the ink supply source is supplied into the common ink chambers 7 through the ink supply ports 47 positioned at the first longitudinal ends of the common ink chambers 7. The four ink supply ports are individually denoted by reference numerals 47*a*, 47*b*, 47*c*, 47*d*, left to right as seen in FIG. 2.

The ink introduced into the common ink chambers 7 through the ink supply ports 47 is ultimately supplied to the individual nozzles 4. More specifically, the ink is first distributed from each common ink chamber 7 functioning as an ink supply channel, to the pressure chambers 38, via the connecting passages 40 formed in the supply plates 15 and the through-holes 38 formed through the base plate 16, as shown in FIG. 3. Then, pressurized in each pressure chamber 36 by driving of the piezoelectric actuator unit 2, the ink is supplied to the corresponding nozzle 4 via the communication holes 37.

As shown in FIG. 2, there are four ink supply ports 47 for five common ink chambers 7. That is, one 47*a* of the ink supply ports 47 is connected to two common ink chambers 7, 7, to supply black ink thereinto. This is because that the black ink is more frequently used than the other color inks, namely, yellow, magenta, and cyan inks, each of which is supplied through a single ink supply port 47*b*, 47*c*, 47*d*, respectively. A filter member having filtering portions 20*a* is attached to the cavity plate 17 with an adhesive or otherwise, such that the filtering portions 20*a* cover the respective ink supply ports 47*a*-47*d*, as shown in FIG. 2.

The cavity unit 1 is produced as follows. Initially, a first subunit 1*a* and a second subunit 1*b* as shown in FIG. 4 are separately prepared. The first subunit 1*a* comprises two plates, namely, the nozzle plate 11 and space plate 12, and the second subunit 1*b* comprises six plates, namely, the damper plate 13, manifold plates 14*a*, 14*b*, supply plate 16, base plate 16, and cavity plate 17. Then, the first and second subunits 1*a*, 1*b* are stacked and attached to each other.

As described above, the common ink chambers 7 are formed by stacking the damper plate 13, two manifold plates 14*a*, 14*b*, and supply plate 15 in the order of description from bottom up. More specifically, in each of the manifold plates 14*a*, 14*b*, the elastic material 50 is initially provided by filling, attaching or otherwise inside each precursory through-hole of the common ink chamber 7, as shown in FIG. 2, and thereafter the manifold plates 14*a*, 14*b* are stacked with the other plates to form the second subunit 1*b*.

The cavity unit 1 may be produced according to another process than as described above. For instance, the number of manifold plates may not be two, i.e., one or three or more manifold plate(s) may be used, the common ink chambers 7 may not be constituted by through-holes formed through the manifold plate(s), but by recesses formed on a surface of a relevant metal plate(s), or the procedures of producing the cavity unit may be different from the above-described one. Where such other processes are employed in producing the cavity unit 1, the step of providing the elastic material 50, by filling and attaching for instance, may be suitably modified.

The recesses and through-holes constituting the ink supply ports 47, common ink chambers 7, communication holes 37, through-holes 38, connecting passages 40, and damper chambers 45, are formed in the metal plates 12-17 by etching, electric discharge machining, plasma machining, or laser beam machining, for instance. The filter member 20, which is formed of a single thin sheet of synthetic resin, such as polyimide, having a substantially rectangular shape as seen from the upper side, has the filtering portions 20*a* where minute openings are formed by laser beam machining or other methods. Where the filter member 20 is formed of metal, electroforming may be employed for forming the filter member 20.

On the other hand, the piezoelectric actuator unit 2 is constructed as disclosed in JP-A-4-341853, for instance. That is, the actuator unit 2 is formed of a laminate of a plurality of piezoelectric sheets, although not shown, and each of the piezoelectric sheets has a thickness of about 30 μm. On an upper surface of each even-numbered sheet as counted from the bottom, narrow individual electrodes are arranged in rows each extending along a longitudinal direction of the piezoelectric actuator unit 2 or the X-axis direction and at respective positions corresponding to the pressure chambers 36 in the cavity unit 1. On an upper surface of each odd-numbered piezoelectric sheet as counted from the bottom, there are formed common electrodes each of which is common to a plurality of the pressure chambers 36. On an upper surface of the topmost one of the piezoelectric sheets, there are formed surface electrodes 48 comprising individual surface electrodes 48 which are electrically connected to the respective individual electrodes, and common surface electrodes which are electrically connected to the common electrodes.

When a high voltage is applied between the individual electrode 44 and the common electrode 46, in a way well known in the art, the portion of the piezoelectric sheet sandwiched between these electrodes 44, 46 is polarized and serves as an active portion.

An adhesive sheet (not shown) of synthetic resin impervious to the inks is attached over an entirety of an undersurface (i.e., the surface to be opposed to the pressure chambers 36) of the thus constructed planar piezoelectric actuator unit 2. Then, the piezoelectric actuator unit 2 is attached to the cavity unit 1 such that the individual electrodes of the actuator unit 2 are positioned to correspond to the pressure chambers 36 in the cavity unit 1. Thereafter, the flexible flat cable 3 shown in FIG. 4 is pressed onto an upper surface of the piezoelectric actuator unit 2 to be connected thereto such that wiring (not shown) of the flexible flat cable 3 is electrically connected with the surface electrodes 48.

In the printhead 100 constructed as described above, the inks supplied from the ink supply source are introduced into the common ink chambers 7 through the ink supply ports 47, then distributed to the pressure chambers 36, and pressurized to be ejected from the nozzles 4. In each common ink chamber 7, the diminution at the portion A remote from the ink supply port 47 prevents stagnation of the ink flow and accordingly accumulation or stay of air bubbles, which would be otherwise caused there, eliminating the possibility of mixing of air bubbles in the ink.

When a predetermined drive voltage is selectively applied to an individual electrode of interest through the flexible flat cable 3, a deformation in the direction of stacking of the piezoelectric sheets occurs at the active portion, by the transverse piezoelectric effect. More specifically, in a normal state where any active portion is not activated, a drive voltage is kept applied between all pairs of the individual electrode 44 and the common electrode 46, creating at every active portion an electric field in the polarization direction to expand the active portion in the stacking direction so as to keep reducing the inner volume of all the pressure chambers 36. That is, the level of a pulse train of a drive signal for each individual electrode is normally kept at HIGH. In this state, when the level of a pulse train of a drive signal for a particular individual electrode is made LOW, the expansion of the active portion corresponding to that individual electrode due to the application of the drive voltage is eliminated, thereby increasing or restoring the inner volume of the corresponding pressure chamber 36 and producing a pressure wave in the ink in the pressure chamber 36. This pressure wave once propagates toward the nozzle 4 through an ink channel including the pressure chamber 36. More specifically, the ink channel comprises the connecting passage 40, through-hole 38, pressure chamber 36, communication holes 37, and nozzle 4. Then, at a timing, the direction of the propagation of the pressure wave reverses. At this timing, the level of the pulse wave is made HIGH, that is, the drive voltage is again applied to the particular individual electrode 44 to expand the active portion. Thus, the pressure applied by the expansion of the active portion is superposed on the pressure wave whose propagation direction is reversed toward the nozzle, thereby pressurizing the ink in the pressure chamber 36 to eject the ink in the form of a droplet from the nozzle 4, to form a dot on a recording medium or the like as desired.

Figure 6A:
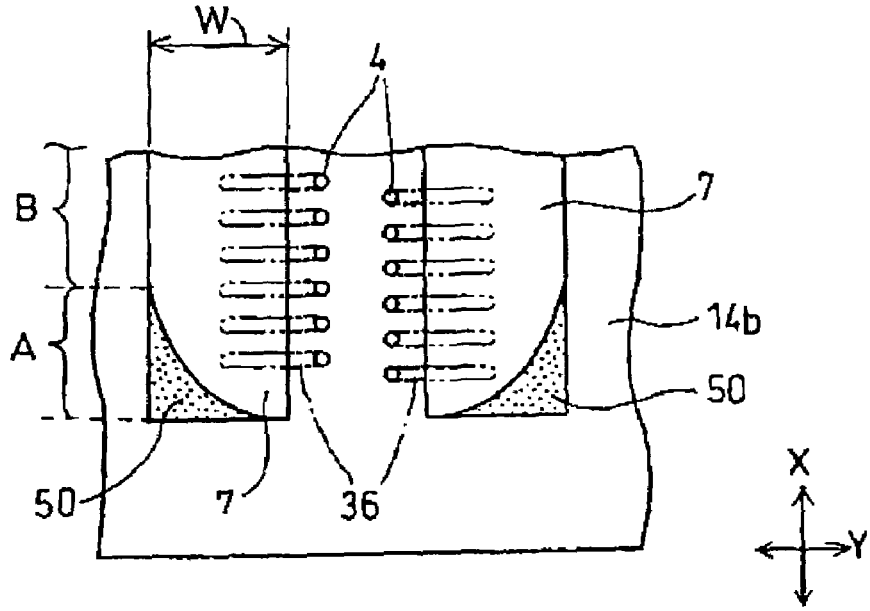
FIG. 6A is a schematic view of an end portion of a common ink chamber in the cavity unit, as seen from the upper side.

As shown in FIG. 6A, the diminution at the portion A is provided by disposing the elastic material 50 having a negligibly low rigidity compared with that of the metal material forming the plate 14*a*, 14*b*. The elastic material 50 directly contacts the ink in the common ink chamber 7. Thus, at the portion A, the common ink chamber 7 is actually narrowed in shape, but can be considered to have the same width W as the portion B in terms of the rigidity with respect to the row of the pressure chambers. Therefore, the influence of the rigidity of the manifold plates 14*a*, 14*b* on the ejection of ink droplets is substantially uniform between the pressure chambers in an area corresponding to the portion A and the pressure chambers in another area corresponding to the portion B. Accordingly, the characteristic period is made uniform among the ink channels each including a pressure chamber, eliminating the variation among the nozzles 4 in the ink ejection characteristics such as the ejection speed.

Figure 7A:
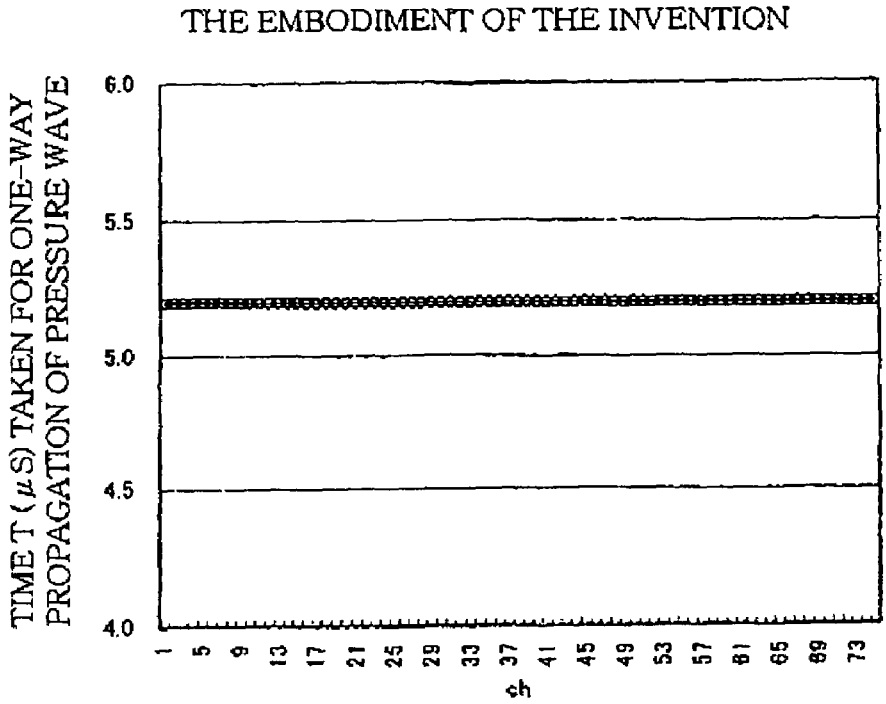
FIG. 7A is a graph showing a result of an experiment conducted for the inkjet printhead of the first embodiment on a relationship between the position of nozzles and the time taken for one-way propagation of pressure.

An experiment was conducted to obtain, for each nozzle, the time T (μs) taken for a pressure wave to propagate one-way or toward the nozzle through the ink channel, in the inkjet printhead according to the present embodiment. The result of this experiment is shown in the graph of FIG. 7A. The printhead used in this experiment has 75 nozzles in a row which are consecutively numbered from one end of the row corresponding to the first longitudinal end of the common ink chamber 7, to the other end of the row corresponding to the second longitudinal end of the common ink chamber 7 where the cross-sectional area gradually diminishes. The abscissa of the graph represents the numbers 1-75 assigned to the ink channels or the nozzles. As shown in FIG. 7A, the time T taken for the pressure wave to propagate toward the nozzle through the ink channel including the pressure chamber is uniform among all the nozzles. Accordingly, the time from the moment when the level of the pulse train of the drive signal for the pressure chamber is made LOW to the moment when the ink droplet is ejected, is uniform among all the nozzles.

Figure 7B:
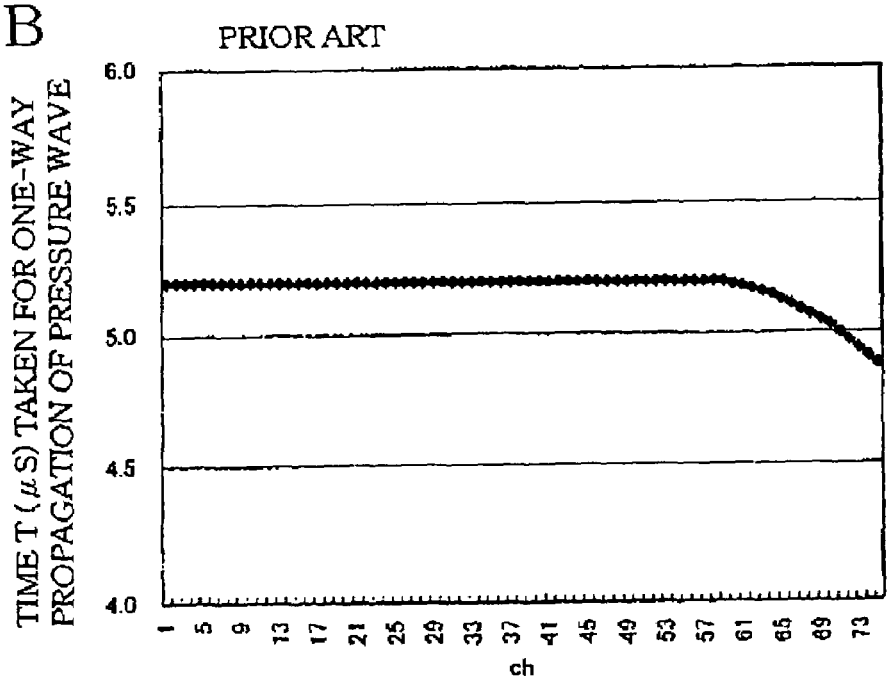
FIG. 7B is a graph showing a result of an experiment conducted for an inkjet printhead of prior art on a relationship between the position of nozzles and the time taken for one-way propagation of pressure.

FIG. 7B shows a result of a comparative experiment conducted in the same way as described above with respect to FIG. 7A, with a conventional inkjet printhead having common ink chambers which are constituted by through-holes formed in the metallic manifold plate 14*a*, 14*b* in a narrowing shape without using the elastic material 50. As shown in FIG. 7B, with the conventional structure, the uniformity in the rigidity of the manifold plates in a region across which the pressure chambers are aligned is lost, by an influence of the diminution in cross-sectional area at the portion A. Accordingly, the time T taken for the pressure wave to propagate one-way toward the nozzle varies among the nozzles, namely, gradually decreases in a range of the nozzles numbered 60 to 75, in a direction from the nozzle numbered 60 to the nozzle numbered 75, which is located over the second longitudinal end of the common ink chamber remote from the ink supply port.

Observing the results of the two experiments, it is confirmed that according to the embodiment the time T taken for the pressure wave to propagate one-way through the ink channel including the pressure chamber is uniform among all the ink channels or among all the nozzles, even with the common ink chamber 7 including the narrowed portion, thereby eliminating the variation in the ink ejection characteristics among the nozzles in a single nozzle row.

Figure 6B:
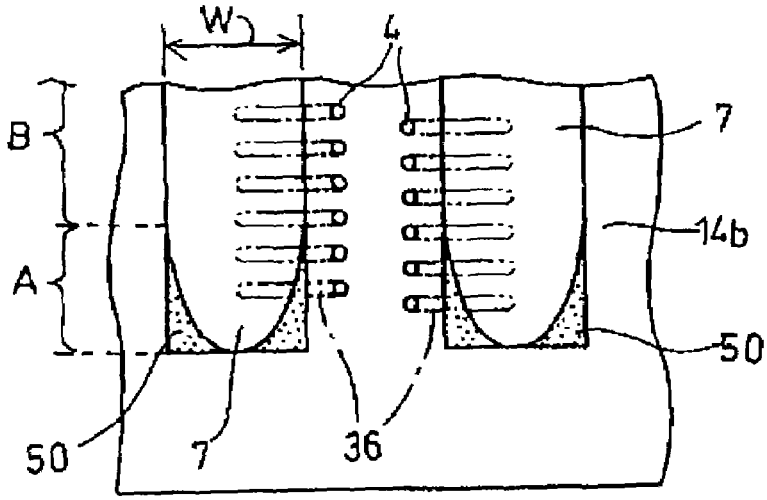
FIG. 6B is a schematic view of an end portion of a common ink chamber in a cavity unit of an inkjet printhead according to a second embodiment of the invention.

In the first embodiment as shown in FIG. 6A, in order to provide the narrowed part, a part of the common ink chamber 7 is filled with the elastic material 50 but only along one longitudinal lateral side thereof. However, the first embodiment may be modified as shown in FIG. 6B, that is, the portion of the common ink chamber 7 may be filled with the elastic material 50 along both of the longitudinal lateral sides so as to provide a narrowed portion.

As long as a surface of the compensating member in contact with the ink is impervious to both of the ink and air, the material of the compensating member may not be limited to silicone rubber, but may be selected from any other materials having an ink resistance, and being more easily deformable than the metal forming the manifold plates, and impervious to the ink. For instance, a gel material insoluble to the ink may be employed. Further, the material of the compensating member may contain a great number of discrete gas bubbles which are dispersed in a fashion not to contact the ink.

In order to reliably prevent the ink from permeating the compensating member, it is particularly desirable that the surface of the compensating member is coated with a material impervious to the ink.

Figure 8A:
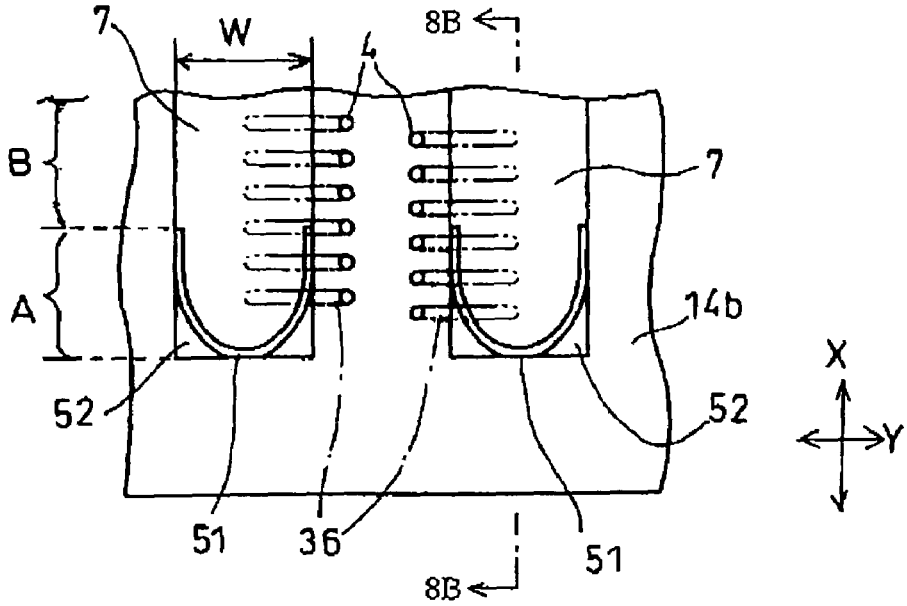
FIG. 8A is a schematic plan view of a common ink chamber in an inkjet printhead according to a second embodiment of the invention, as seen from the upper side.
Figure 8B:
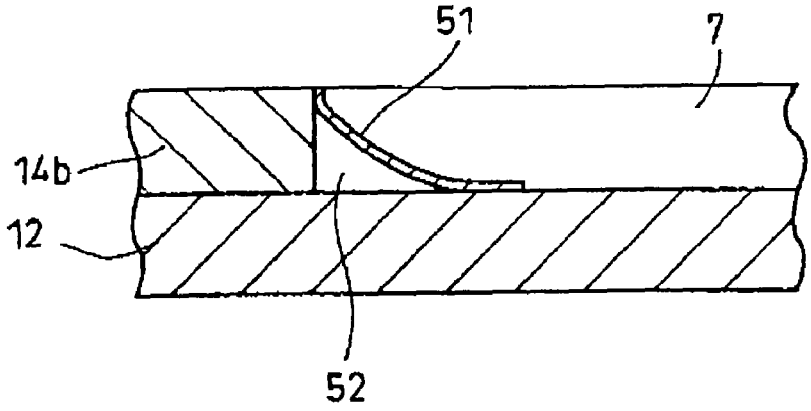
FIG. 8B is a cross-sectional view taken along line 8B-8B in FIG. 8A.

Referring now to FIGS. 8A and 8B, there will be described an inkjet printhead according to a second embodiment of the invention. FIG. 8A is a schematic plan view of a common ink chamber in the printhead, as seen from the upper side, and FIG. 8B is a cross-sectional view taken along line 8B-8B in FIG. 8A. The same elements or parts as those in the first embodiment will be denoted using the same reference numerals, and description thereof is dispensed with.

In the first embodiment, the common ink chamber 7 is narrowed at the portion A or at the second longitudinal end, filled with the elastic material 50 as a compensating member. According to the second embodiment, the compensating member is constituted by a combination of a flexible film 51 and an air space 52, instead of the elastic material 50. More specifically, the air space 52 is provided at the portion A via the flexible film 51 so as to narrow the common ink chamber 7. As a material of the flexible film 51, a sheet material exhibiting an ink resistance is employed.

According to the second embodiment, the manifold plate 14*a* and the damper plate 13 as used in the first embodiment are omitted, but common ink chambers 7 are constituted by through-holes formed through a single manifold plate 14*b* which is superposed on a space plate 12, as shown in FIG. 8B. At the portion A, the flexible film 51 completely insulating the air space from the ink is fixed to both longitudinal sides of the common ink chamber 7, a short side at a longitudinal end of the common ink chamber opposite from an ink supply port from which the ink is introduced, and an upper surface of the spacer plate 12 which defines a bottom surface of the common ink chamber 7. Thus, air space 52 and the flexible film 51 constituting the compensating member extend alongside a part of a lower surface of the manifold plate 14 (or the bottom of the common ink chamber 7 defined by the upper surface of the spacer plate 12), as well as alongside two opposed longitudinal lateral sides, so as to form a narrowed part of the common ink chamber at the portion A.

Since the air space 52 is insulated from the ink by the flexible film 51, and not by a metal material as in the above-mentioned publication JP-A-2002-137386, the ink is in direct pressure communication with the air space 52 at the portion A, eliminating the adverse influence of the high rigidity of the metal material on the uniformity in the time T of the pressure-wave propagation among ink channels. Extending alongside the bottom surface of the common ink chamber 7, the air space 52 functions to absorb or damp the pressure change propagated to the common ink chamber 7, in the same way as the damper chamber 45 in the first embodiment does, thereby providing the effect of preventing the crosstalk among the pressure chambers. Hence, the printhead according to the second embodiment does not include the damper plate 13 used in the first embodiment, reducing the components cost. The other part of the operation and effects of the second embodiment is identical with those of the first embodiment.

The second embodiment may be modified such that the air space 52 does not extend alongside the bottom surface of the common ink chamber 7, or such that the damper plate 13 as used in the first embodiment is employed.

In the second embodiment also, it is essential that the surface of the compensating member in contact with the ink is impervious to the ink and air. Accordingly, the material of the flexible film 51 should be impervious to the ink.

Meanwhile, the space defined between the flexible film 51 and the surfaces of the manifold and the spacer plates 14*b*, 12 may be filled with any other materials than the air, as long as the materials are more easily deformable than the metal forming the manifold plates. For instance, the filler, i.e., the material filling the space, may be a gas other than air, a liquid substance, a resin, or a rubber. Further, the filler may be a foamed material.

Figure 10:
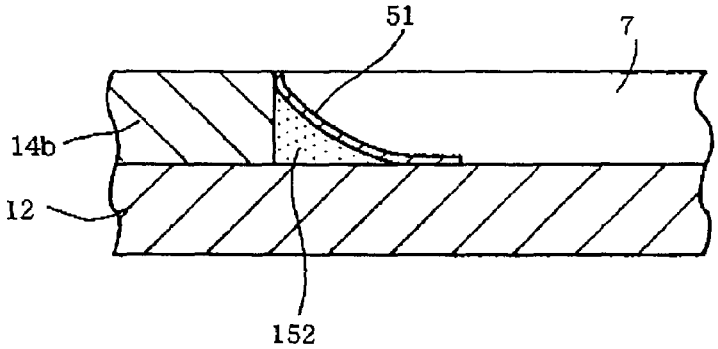
FIG. 10 is a cross-sectional view of a common ink chamber according to another modification of the second embodiment, as seen in the same direction as FIG. 8B.

FIG. 10 shows a modification of the second embodiment where a filler 152 inside a flexible film 51 is a material other than air and is compressible, or more easily deformable than the metal forming the manifold plates 14*a*, 14*b*. According to this modification, the same effects as the second embodiment can be obtained.

According to the second embodiment where the common ink chambers 7 are formed in the manifold plates 14*a*, 14*b* of a metal as a common-chamber member, while a compensating member disposed to reduce the cross-sectional area of the common ink chamber is constituted by a combination of a flexible film and a filler (i.e. the air) insulated from the ink by the flexible film, which have an extremely low rigidity compared with the metal, it can be virtually considered in terms of the rigidity such that the narrowed portion with the diminishing cross-sectional area is not provided in the common ink chamber, or the width of the common ink chamber is constant throughout the entire length.

Figure 9:
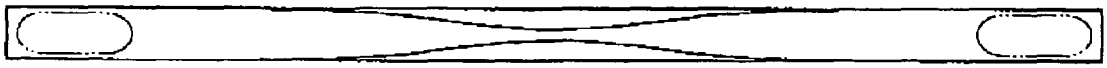
FIG. 9 is a schematic plan view of a common ink chamber according to a modification of the second embodiment, as seen from the upper side.

In each of the above-described embodiments, the compensating member having a relatively low rigidity is disposed at one of two opposite longitudinal ends of each elongate common ink chamber 7, since the ink is supplied into the common ink chamber through the ink supply port connected to the other longitudinal end. However, there may be a case where an ink supply port is connected to each of the two longitudinal ends of each common ink chamber so as to supply the ink into the common ink chambers, as indicated by two-dot chain line in FIG. 9. In such an arrangement, the deceleration and the stagnation of the ink flow occur at a middle portion of the common ink chamber in the longitudinal direction thereof In this case, the compensating member is disposed at the middle portion, not at a longitudinal end, of the common ink chamber. In this case, too, the same effects as the first and second embodiments and the modifications thereof can be obtained.

In each of the above-described embodiments, the actuator is of piezoelectric type. However, the principle of this invention is applicable to an inkjet printhead employing an actuator of any other types than the piezoelectric type, as long as the actuator can apply pressure to the ink in the pressure chambers. For instance, the invention is applicable to an inkjet printhead using an electromechanical transducer as the actuator.

What is claimed is:

1. An inkjet printhead comprising:

a cavity unit having:

a plurality of nozzles which are open in a surface of the cavity unit and arranged in a row;

a plurality of pressure chambers formed in a row in the cavity unit to correspond to the nozzles; and a common-chamber member in which a common ink chamber is formed, the common ink chamber being connected, at at least one ink introduction place, to an ink supply source storing ink so as to receive the ink therefrom and distribute the ink to the pressure chambers;

an actuator unit superposed on the cavity unit to selectively pressurize the ink in each of the pressure chambers to eject a droplet of the ink from the nozzle corresponding to the pressure chamber;

the common ink chamber extending along the row of the pressure chambers so as to overlap at least a part of each pressure chamber when seen in a direction of superposition of the cavity unit and the actuator unit; and a compensating member constituted by a material having a rigidity lower than that of a material of the common-chamber member, and disposed in the common ink chamber and in contact with the ink, at at least a remote portion far from the at least one ink introduction place, so that a cross-sectional area of the common ink chamber perpendicular to the longitudinal direction thereof gradually decreases at least at the remote portion in a direction away from each of the at least one ink introduction place, a cross-sectional area of the compensating member increases as the cross-sectional area of the common ink chamber decreases, and a supporting rigidity of the common-chamber member with respect to the pressure chambers is substantially uniform across a region corresponding to the row of the pressure chambers, along the direction of the row of the pressure chambers.

2. The inkjet printhead according to claim 1, wherein the ink introduction place and the remote portion are located at two opposite longitudinal ends of the common ink chamber, respectively.

3. The inkjet printhead according to claim 1, wherein the gradual decrease in the cross-sectional area is made by gradually reducing a width dimension of the common ink chamber.

4. The inkjet printhead according to claim 3, wherein the common ink chamber is formed such that an opening is initially formed in the common-chamber member to have a width dimension substantially constant throughout an entire length of the opening, and then the compensating member is disposed at a portion in the opening, which corresponds to the remote portion in the common ink chamber, so as to decrease the cross-sectional area of the opening there.

5. The inkjet printhead according to claim 1, wherein the common-chamber member is made of a metal, and the compensating member is constituted by an elastic material filling a part of the remote portion so as to decrease the cross-sectional area of the common ink chamber there.

6. The inkjet printhead according to claim 5, wherein the elastic material is a silicone rubber.

7. The inkjet printhead according to claim 5, wherein the elastic material is a gel material impervious to the ink.

8. The inkjet printhead according to claim 5, wherein the elastic material is a material containing a great number of discrete gas bubbles which are dispersed in a fashion not to contact the ink.

9. The inkjet printhead according to claim 5, wherein the elastic material is coated with an ink impervious material so that the elastic material is reliably insulated from the ink.

10. The inkjet printhead according to claim 1, wherein the common-chamber member is made of a metal, and the compensating member is constituted by a combination of a flexible film and a filling material which are disposed at the remote portion so as to decrease the cross-sectional area of the common ink chamber there, the filling material being more easily deformable than the metal, and insulated from the ink by the flexible film.

11. The inkjet printhead according to claim 10, wherein the filling material and the flexible film thereon are disposed to extend alongside a part of a bottom surface of the common ink chamber.

12. The inkjet printhead according to claim 10, wherein the filling material is compressible.

13. The inkjet printhead according to claim 12, wherein the filling material is gas.

14. The inkjet printhead according to claim 12, wherein the filling material is a foamed material.

15. The inkjet printhead according to claim 14, wherein the filling material is a material containing a great number of discrete gas bubbles which are dispersed in a fashion not to contact the ink.

16. The inkjet printhead according to claim 10, wherein the filling material is a liquid substance.

17. The inkjet printhead according to claim 10, wherein the filling material is a gel material.

18. The inkjet printhead according to claim 10, wherein the filling material is a resin.

19. The inkjet printhead according to claim 1, wherein the common ink chamber has a constant depth and a constant width over a length corresponding to the row of the pressure chambers.

* * * * *